US007578078B2

(12) United States Patent
Gandolfi

(10) Patent No.: US 7,578,078 B2
(45) Date of Patent: Aug. 25, 2009

(54) SNOWPLOUGH BLADE WITH ADJUSTABLE WIDTH

(75) Inventor: Fabio Gandolfi, Lizzano in Belvedere (IT)

(73) Assignee: Assaloni 1920 S.r.l., Lizzano in Belvedere (Bologna) (IT)

( * ) Notice: Subject to any disclaimer, the term of this patent is extended or adjusted under 35 U.S.C. 154(b) by 0 days.

(21) Appl. No.: 11/861,022

(22) Filed: Sep. 25, 2007

(65) Prior Publication Data

US 2009/0077834 A1 Mar. 26, 2009

(51) Int. Cl.
*E01H 5/06* (2006.01)
*E02F 3/76* (2006.01)

(52) U.S. Cl. ..... 37/281; 37/266; 172/815

(58) Field of Classification Search ..... 37/281, 37/266, 234, 279; 172/815, 782, 786, 684.5, 172/816

See application file for complete search history.

(56) References Cited

U.S. PATENT DOCUMENTS

| | | | | | |
|---|---|---|---|---|---|
| 2,218,512 | A | * | 10/1940 | Ball | 37/279 |
| 3,477,151 | A | * | 11/1969 | Zanella | 37/281 |
| 3,807,064 | A | * | 4/1974 | Schmidt, Jr. | 37/283 |
| 4,074,448 | A | * | 2/1978 | Niemela | 37/234 |
| RE31,045 | E | * | 10/1982 | Essell, et al. | 37/281 |
| 4,369,847 | A | | 1/1983 | Mizunuma | |
| 4,667,426 | A | | 5/1987 | Howard et al. | |
| 5,392,538 | A | * | 2/1995 | Geerligs et al. | 37/268 |
| 5,638,908 | A | * | 6/1997 | Masumoto et al. | 172/815 |
| 5,921,326 | A | * | 7/1999 | Ragule | 172/815 |
| 6,412,199 | B1 | * | 7/2002 | Quenzi et al. | 37/281 |
| 6,877,258 | B2 | * | 4/2005 | Frey | 37/281 |
| 2003/0226289 | A1 | | 12/2003 | Geerligs | |
| 2007/0089327 | A1 | * | 4/2007 | Watson | 37/281 |

FOREIGN PATENT DOCUMENTS

JP 63022906 A 1/1988

OTHER PUBLICATIONS

International Search Report.

* cited by examiner

*Primary Examiner*—Thomas A Beach
(74) *Attorney, Agent, or Firm*—William J. Sapone; Coleman Sudol Sapone P.C.

(57) ABSTRACT

A snowplough blade with adjustable width, of the type including: a first, stationary blade body (L1), supported by a frame (S) for suspension and coupling to a respective machine (O); and a second blade body (L2), connected to the first blade body (L1) by mutual coupling means, sliding and moving with respect to the latter, operated by actuating means (A) between a retracted position (R) and an extreme advanced position (EA), in which the snow-removing surface of the snowplough blade (L) is maximum. The second blade body (L2) is situated in front of the first blade body (L1). The first blade body (L1) includes a tubular cross-beam (1), connected to the suspension and coupling frame (S) and housing the actuating means (A).

2 Claims, 5 Drawing Sheets

SNOWPLOUGH BLADE WITH ADJUSTABLE WIDTH

BACKGROUND

The present invention relates to snowplough blades, that is, apparatuses carried by suitable machines (agricultural tractors, trucks) in order to remove the snow from the ground.

The machines are operated to adjust their snow removing front part according to the contingent needs and the characteristics of the road paths (roads with reduced width, with one or more lanes, etc.)

Different types of snowplough blades with variable width are known to those experts in the field, and substantially they include: a first stationary blade body, carried by a frame for suspension and coupling to a respective vehicle. The first stationary blade body includes, situated in its lower part, shock absorbers for coupling with a flexible scraper which bends with respect to the first blade body in the direction opposite to the blade forward movement in case of collisions with obstacles or irregularities of the road surface; a second blade body, connected with its rear part to the first blade body, by means of mutual coupling, sliding and moving with respect to the latter between an inner retracted position, in which the front of the snowplough blade is formed only by the first blade body, and an extreme advanced position, in which the front of the blade is formed by the first and second blade bodies, arranged abreast, with the second blade body situated on the right with respect to the vehicle forward movement direction and having, likewise in its lower part, shock absorbing means for coupling with a related scraper.

In particular, the Utility Model Application no. BO2002U 000069, of the same Applicant, is distinguished by the fact that the first stationary blade body forms, on its rear surface, facing the second moving blade body, a shoulder for supporting mutual coupling means, so as to keep the second blade body at a distance with respect to the first blade, to delimit a free space.

When the second blade body is in the inner retracted position, the scraper of the first blade body moves into the free space while bending because of collision with obstacles or irregularities of the road surface.

In spite of the many technical-functional advantages of the above mentioned solution, some drawbacks must be pointed out, with reference to the enclosed Figures related to prior art, in which FIGS. 1A, 1B, 1C, 1D are corresponding plan views of the snowplough blade in as many significant configurations, and FIG. 4 is a scheme of a snowplough machine, having a third lateral blade in work configuration.

The snowplough blade AL includes: a first blade body AL1, supported by a structure AS for suspension and coupling with a respective operative vehicle (not shown); and a second blade body AL2, connected to the rear part of the first blade body AL1, parallel thereto, by means of mutual sliding coupling means, and moved with respect to the first body between an inner retracted position (FIGS. 1A, 1C) and an extreme advanced position (FIGS. 1B, 1D) by operation of hydraulic jack, interposed between the structure AS and the second blade body AL2.

As it can be noted, the space occupied by the suspension and coupling structure AS connected to the first blade body AL1 defines a limit to the width of the second blade body AL2, when it is in the retracted position.

This fact limits also the maximum width of the snowplough blade AL as a whole, also considering that the maximum width of the first blade body AL1 is related to the vehicle width, for space and safety reasons.

Another width limit of the second blade body AL2 is imposed by practical reasons: actually, the vehicle driver can find it difficult to estimate the real dimension of the second blade body AL2 in extreme advanced position (see for instance FIG. 1C) during the snow clearing, due to the his unfavorable position in the cabin (conventionally on the left).

This obviously results in a high risk of collisions and damages to the objects out of the road.

Another disadvantage of this configuration results from a limited, or lacking, utility of the lateral snowplough blade, situated on the right side (with respect to the forward movement direction) of some vehicles, when the second blade body AL2 is brought to the extreme advanced position (see FIG. 4).

SUMMARY OF THE INVENTION

Therefore, the object of the present invention is to propose a snowplough blade with adjustable width, which can avoid the reported disadvantages of the prior art.

Another object of the present invention is to propose a snowplough blade, that, in minimum front width condition, allows the operative vehicle, to which it is connected, to operate in symmetry condition and that, in maximum front width condition, makes up a total dimension wider than the known solutions.

A further object of the present invention is to propose a snowplough with adjustable width, obtained according to a reliable and functional technical solution, whose costs are relatively limited with respect to the purposes to be obtained.

The above mentioned objects are obtained in accordance with the contents of the claims.

BRIEF DESCRIPTION OF THE DRAWINGS

The characteristic features of the invention, which do not appear from what has been just said, will be better pointed out in the following, in accordance with the contents of the claims and with the help of the enclosed figures, in which:

DETAILED DESCRIPTION OF THE INVENTION

With regard to the enclosed Figures, the reference L indicates the snowplough blade with adjustable width as a whole, proposed by the present invention.

Figure 4:
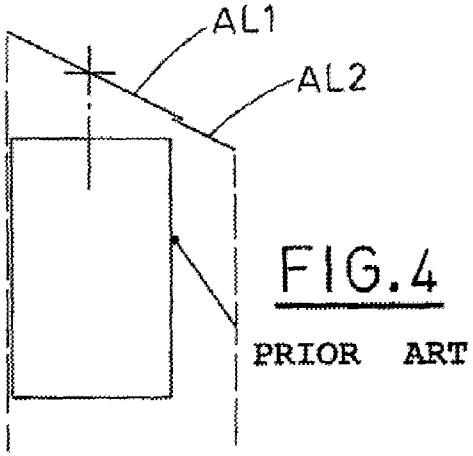
FIG.4 PRIOR ART
FIG. 4 is a schematic, top view of a snowplough carrying vehicle of known type, equipped with a lateral blade.
Figure 5:
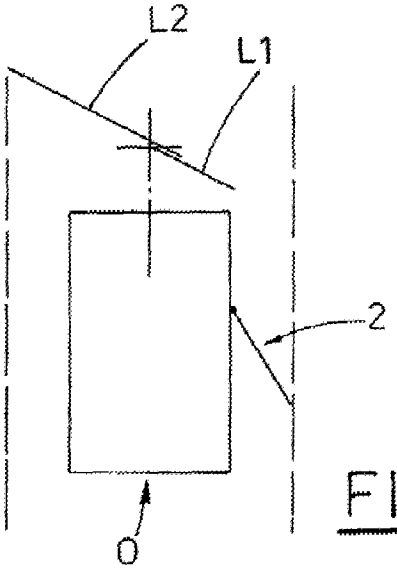
FIG. 5 is a schematic, top view of a vehicle, equipped with a lateral blade and carrying the snowplough blade proposed by the present invention.

The snowplough blade L includes a first, stationary blade body L1, supported by a frame S, of a type known to those skilled in the field and thus not described in detail in its various elements, for suspension and coupling with a respective operative vehicle O (shown schematically only in FIGS. 4, 5).

Figure 2B:
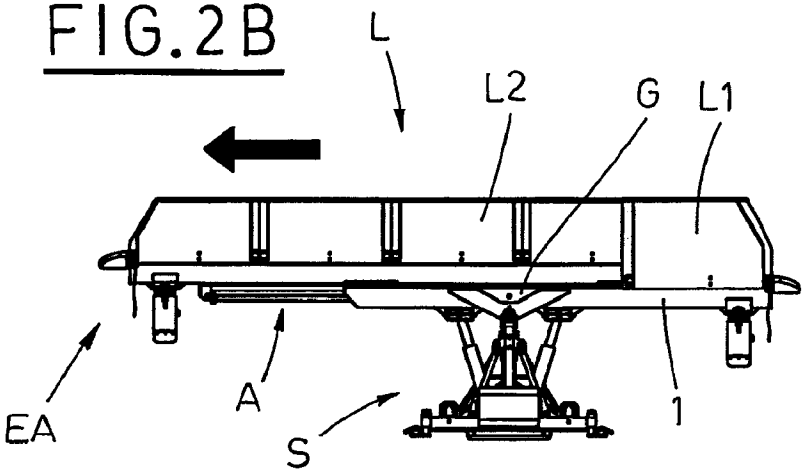
FIGS. 2A, 2B, 2C, 2D are plan views of the snowplough blade proposed by the invention in as may significant configurations.
Figure 2A:
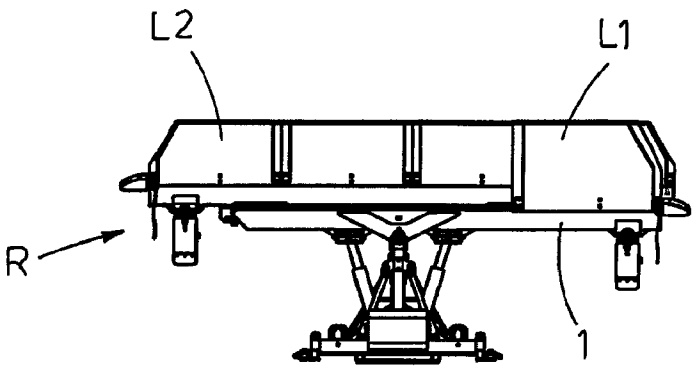
Figure 1B:
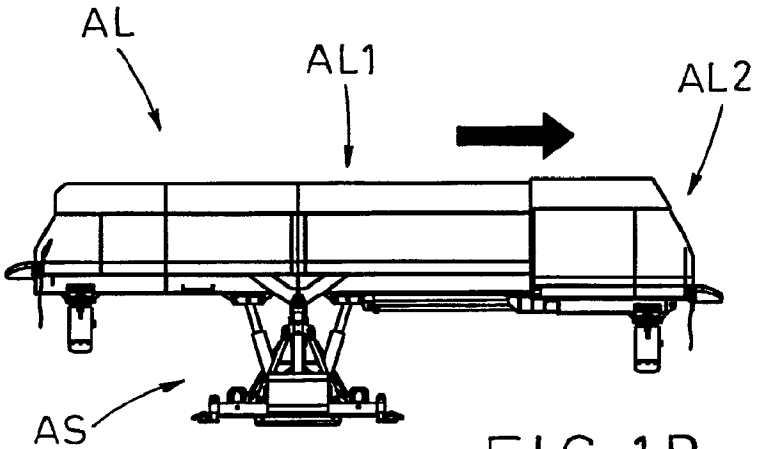
FIG.1B PRIOR ART
FIGS. 1A, 1B, 1C, 1D are corresponding plan views of a known technical solution (in this case the one described in the Application BO2002U 000069) in as many significant configurations.
Figure 1A:
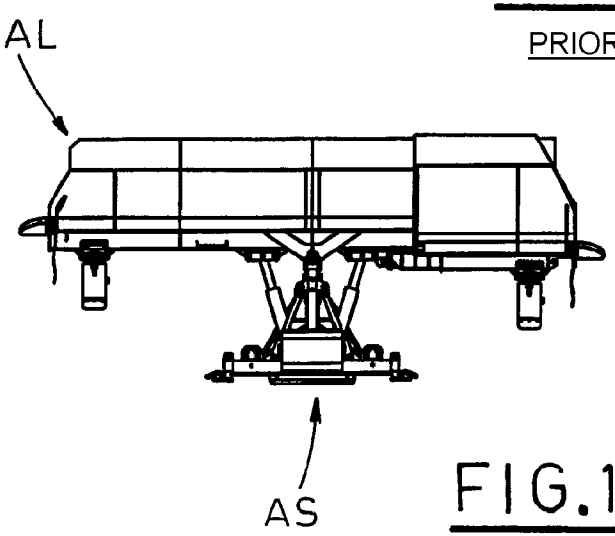
FIG.1A PRIOR ART
Figure 2D:
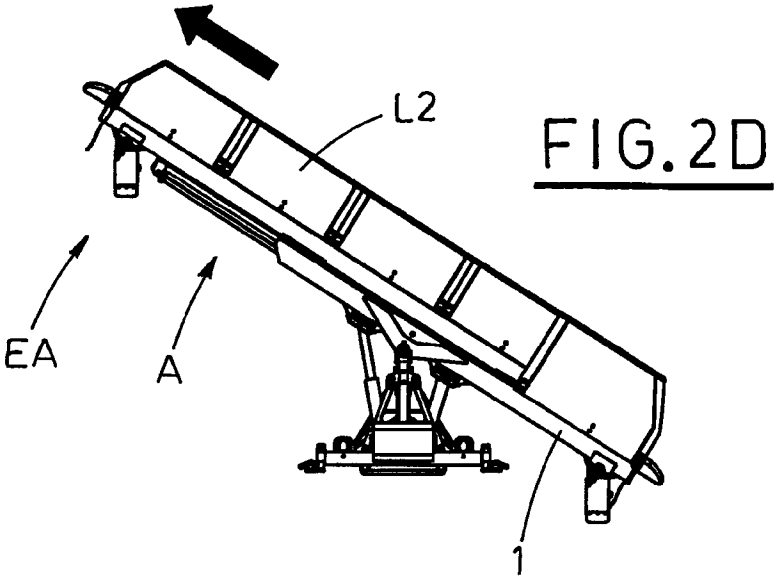
Figure 2C:
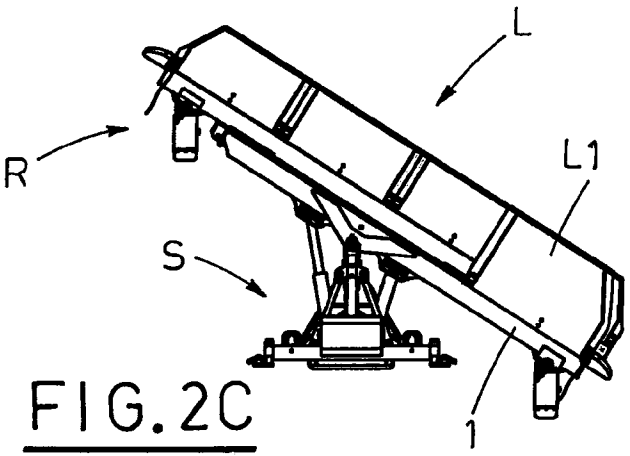
Figure 1D:
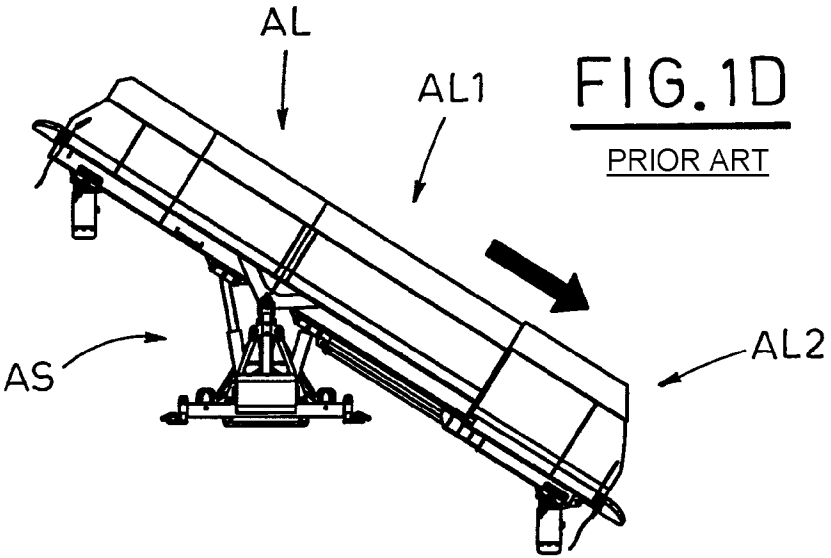
FIG.1D PRIOR ART
Figure 1C:
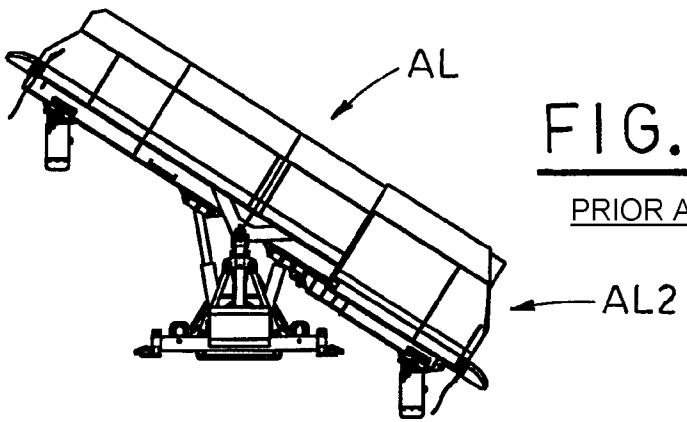
FIG.1C PRIOR ART
Figure 2E:
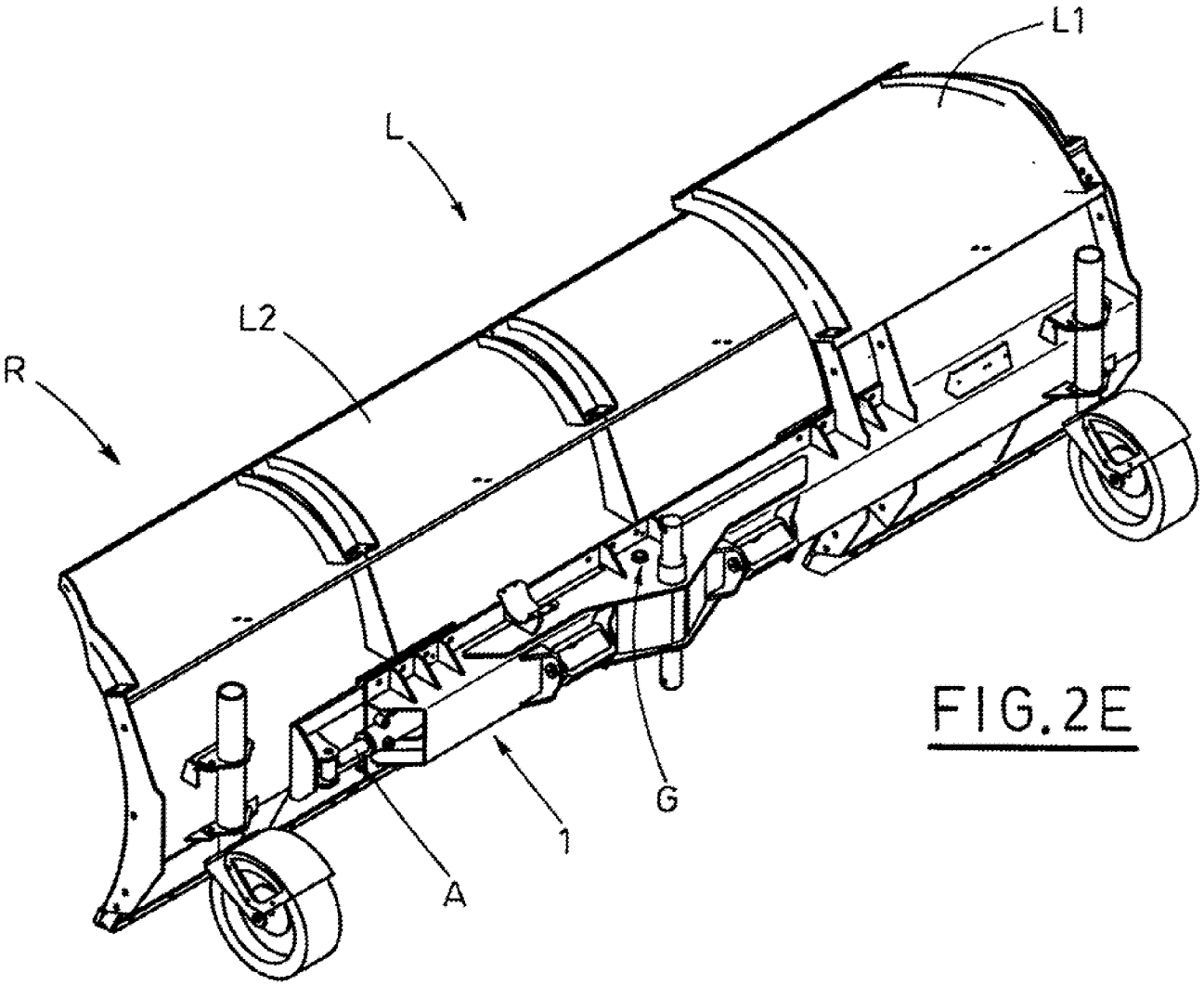
FIG. 2E is a partial, perspective view of the proposed snowplough blade.

A second blade body L2 is connected to the front of the first blade body L1, parallel thereto, by mutual coupling means of sliding type (not shown as known), and is operated to move in translation with respect thereto, by corresponding actuating means A, connected to said suspension frame S, between a retracted position R, in which the snow-removing surface of the snowplough blade L is formed only by the second blade body L2 (FIGS. 2A, 2C), and an extreme advanced position EA, in which the snow-removing surface of the snowplough blade L is formed by two blade bodies L1, L2, arranged one beside the other and with the second blade body L2 on the left of the first one (FIGS. 2B, 2D).

The first blade body L1 includes a tubular cross-beam 1, shaped in a suitable way to be connected externally to the suspension and coupling frame S.

Moreover, the tubular cross-beam 1 houses the actuating means A, including a hydraulic jack, whose ends are fastened respectively to the cross-beam 1 and to the second blade body L2.

Figure 2F:
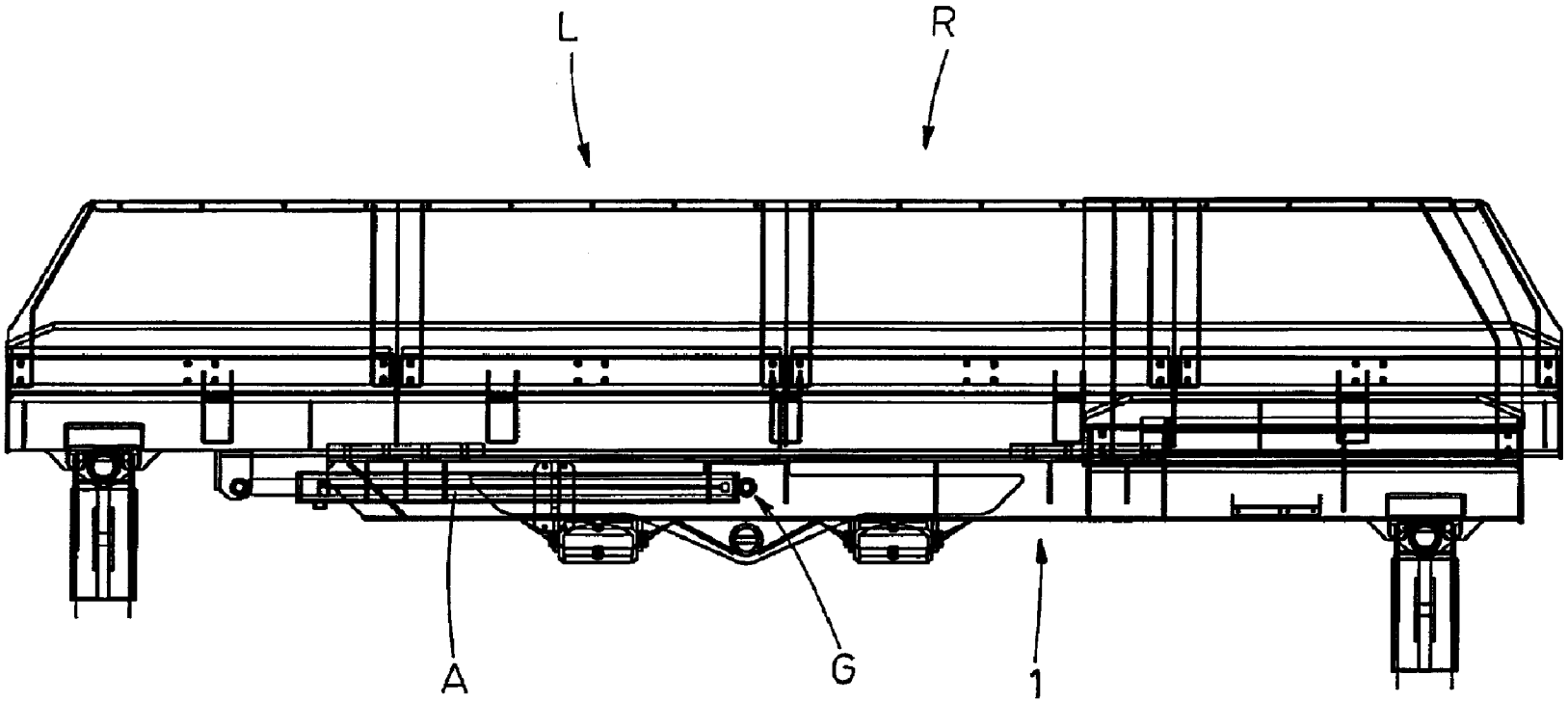
FIG. 2F is a schematic, rear and partial view of the snowplough blade, according to the invention.

According to the example shown in FIG. 2F, the inner end G of the jack A, coupling it to the tubular cross-beam 1 is situated near the center line of the frame S.

It is to be noted that the snowplough blade L is symmetrical to the center line of the machine 0 when the snow-removing surface is minimum, that is when the second blade body L2 is in the retracted position R.

According to the present invention, the connection of the suspension and coupling frame S to the tubular cross-beam 1, integral part of the first blade body L1, is not a limit for the width dimension of the second blade body L2, and consequently of the moving part of the snowplough blade L, as it occurred in the prior art and as it is possible to deduce comparing FIGS. 2A, 2B, 2C, 2D, with FIGS. 1A, 1B, 1C, 1D.

For example, once the width of the second blade body L2 has been determined (equal to the minimum snow-removing surface of the snowplough blade L), the first blade body L1 can have variable dimensions, up to a width comparable with the width of the second blade body L2.

This is made possible by providing a hydraulic jack extending along the whole length of the tubular cross-beam 1.

Therefore, advantageously, it is possible to obtain snowplough blades with adjustable width, with a long stroke between the minimum and maximum snow removing surfaces, thus avoiding successfully the disadvantages of the prior art reported in the introductory note.

In this way, it is possible to adapt the snow-removing surface of the snowplough blade L to a variety of road and highway paths, in relation to their width, thus obtaining a considerable operation flexibility.

Figure 3:
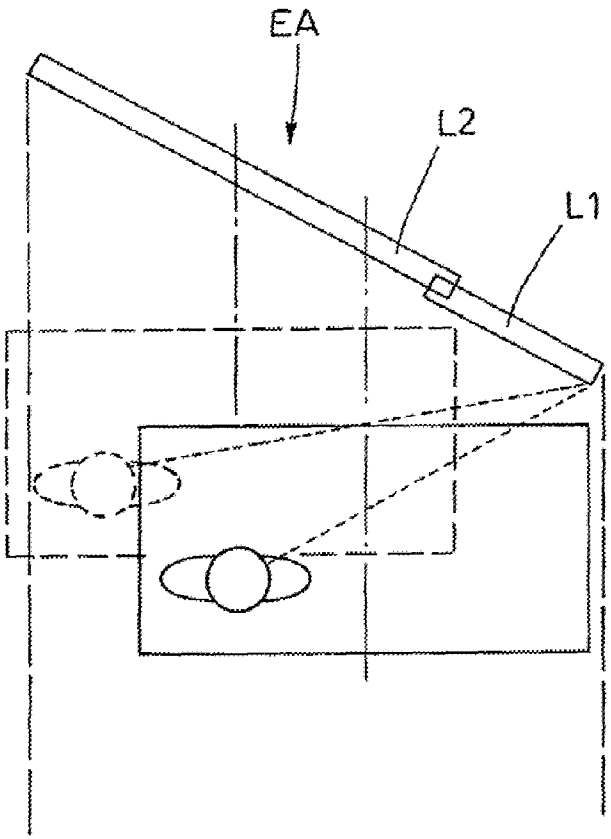
FIG. 3 is a schematic, top view, comparing two possible positions of the driver's cabin in a snowplough carrying vehicle.

FIG. 3 shows schematically, indicated with a continuous and broken lines, the position of the cabin of the machine 0 with respect to the snowplough blade L, in the maximum snow-removing surface configuration, respectively according to the invention and to the prior art.

As it can be seen, according to the present invention, the driver's position is closer to the first blade body L1 and this allows the driver to drive the operative vehicle O safely and to position the snowplough blade L in a better way close to the right side of the road, thus reducing considerably the risk of collision with, and/or damages to, objects out of the road.

Another advantage of the present invention can be seen in operative vehicles O having a lateral blade 2, situated on their right with respect to the movement direction (see FIG. 5).

In this case, the total snow-removing surface removing the snow from the road surface is further increased.

Another advantage of the invention lies in the fact that it has conceived a snowplough blade with adjustable width, obtained according to a reliable and functional technical solution, whose costs are relatively contained with respect to the achieved advantages.

It is understood that what above has been described as a mere, not limiting example. Therefore, it is obvious that any changes or variants applied thereto remain within the protective scope defined by the following claims.

What is claimed is

1. Snowplough blade with an adjustable width, comprising:

a first blade (L1), supported stationary by a frame (S) for suspension and coupling to an operative vehicle (O);

a second blade (L2), slidingly connected to said first blade (L1) by mutual coupling means, and operated by actuating means (A) connected to said suspension frame (S), said second blade body being movable with respect to said first blade (L1) between a retracted position (R), in which a snow-removing surface of said snowplough blade (L) is at a minimum width, and an extreme advanced position (EA), in which the snow-removing surface of said snowplough blade (L) is at a maximum width, the snow-removing surface formed by said first blade and said second blade (L1, L2), being arranged one beside the other, said second blade (L2) being situated in front of said first blade (L1), the second blade (L2) having a width greater than or equal to a width of the first blade, and in that the operation of the second blade (L2) to said extreme advanced position (EA) determines the degree of sliding leftwards translation of the second blade with respect to said first blade (L1), and in that the snow-removing surface of the snowplough blade is formed only by the second blade when the second blade is in the retracted position (R), said first blade (L1) including a tubular cross-beam (1) connected to said suspension and coupling frame (S) and whose inner space is occupied at least partially by said actuating means (A), said actuating means (A) including a hydraulic jack housed inside said tubular cross-beam (1), functionally interposed between the tubular cross-beam (1) and said second blade (L2).

2. Snowplough blade, according to claim 1, wherein said snowplough blade (L) is symmetrical to the center line of said machine (O), when said snow-removing surface is at the minimum width.

* * * * *